United States Patent [19]

Sachs

[11] Patent Number: 4,591,229

[45] Date of Patent: May 27, 1986

[54] GROUNDING STRAP

[76] Inventor: Isaac Sachs, 1240 Ridgewood Drive, Chomedey Laval, Quebec, Canada, H7W 1L3

[21] Appl. No.: 702,429

[22] Filed: Feb. 19, 1985

Related U.S. Application Data

[63] Continuation of Ser. No. 448,750, Dec. 10, 1982, abandoned.

[51] Int. Cl.[4] ..... H01R 13/24

[52] U.S. Cl. ..... 339/251; 339/14 R

[58] Field of Search ..... 339/14 R, 251

[56] References Cited

U.S. PATENT DOCUMENTS 1,830,947 11/1931 Klingel ..... 339/251

2,114,752 4/1938 Tallman ..... 339/251

OTHER PUBLICATIONS

Sachs Canada Ltd.; A Canadian Company for Canadian Demands, Oct. 1978, Product #P/N SC-13, 2095 Chartier Ave., Dorval, Quebec.

*Primary Examiner*—Gil Weidenfeld

*Assistant Examiner*—Paula A. Austin

*Attorney, Agent, or Firm*—Oblon, Fisher, Spivak, McClelland & Maier

[57] ABSTRACT

A one-piece pliable metal grounding strap comprises a U-shaped section having a pair of leg portions interconnected by a bight portion. One of the leg portions has an inwardly bent section extending adjacent thereof and across the bight portion, the bent section being adapted to contact on one side thereof a ground member; a hook member outwardly projects from this leg portion. A collar member is fixed to the bight portion, the collar member having a threaded bore adapted to threadably engage a screw member and being disposed to permit the screw member to frictionally engage the bent section on the other side thereof substantially perpendicularly thereto. The other leg portion is extended relative to the aforesaid one leg portion to define an elongated wrap section adapted to be bent about the ground member and over the one leg portion and the bight portion with the ground member disposed between the bent section and the wrap section. The wrap section is provided with a plurality of longitudinally spaced apart apertures adapted to receive the hook member and to register with the threaded bore for receiving the screw member.

3 Claims, 5 Drawing Figures

10
12
14
16
18
20
22
24
26
28
30
32
34
36
38

GROUNDING STRAP

This application is a continuation of application Ser. No. 448,750, filed Dec. 10, 1982, now abandoned.

BACKGROUND OF THE INVENTION

The present invention relates to a grounding strap and, more particularly, to a pliable metal grounding strap of the type to be bent around a ground member, such as a grounded pipe or metal post, and thereafter secured thereto.

One type of pliable metal grounding strap which has been proposed before comprises an elongated strap member having a plurality of longitudinally spaced apart holes at one end portion and a nut welded thereon at the other end portion. A flap is detachably mounted to the strap member by means of a tab and slot arrangement adjacent the nut and is adapted to be positioned intermediate the ground member and a bolt extending through the nut for securing the strap member to the ground member, prior to bending the strap member around the ground member and over the nut with one strap hole registering with the nut hole and installing the bolt. This two-piece construction is rather disadvantageous since it is difficult and time consuming to install. Further, the flap serving to provide grounding contact between the bolt and the ground member and also to protect the latter from being damaged by the bolt can be easily lost. In addition, since the nut is welded to the strap member, the weld can readily break as a result of repeated use and bending of the strap member.

In order to overcome these disadvantages, Applicant has already proposed a pliable metal grounding strap of the type described above, but in which the welded nut is replaced by a threaded collar riveted to the strap member and the detachable flap is replaced by an inwardly curved strap section integrally joined to one end of the strap member so as to provide a one-piece construction. However, as the curved strap section must first be placed on the ground member and the strap member thereafter bent over such curved section and around the ground member, the bolt or screw is often mispositioned relative to the underlying curved strap section and contacts same at an oblique angle, resulting in a poor grounding contact.

SUMMARY OF THE INVENTION

Accordingly, it is an object of this invention to overcome the aforementioned drawback and to provide a one-piece pliable metal grounding strap which avoids mispositioning of the screw and therefore ensures a good grounding.

In accordance with the present invention, there is thus provided a one-piece pliable metal grounding strap comprising a U-shaped section having a pair of leg portions interconnected by a bight portion. One of the leg portions has an inwardly bent section extending adjacent thereof and across the bight portion, the bent section being adapted to contact on one side thereof a ground member; a hook member outwardly projects from this leg portion. A collar member is fixed to the bight portion, the collar member having a threaded bore adapted to threadably engage a screw member and being disposed to permit the screw member to frictionally engage the bent section on the other side thereof substantially perpendicularly thereto. The other leg portion is extended relative to the aforesaid one leg portion to define an elongated wrap section adapted to be bent about the ground member and over the one leg portion and the bight portion with the ground member disposed between the bent section and the wrap section; the wrap section is provided with a plurality of longitudinally spaced apart apertures adapted to receive the hook member and to register with the threaded bore for receiving the screw member. Tightening of the screw member causes same to frictionally engage with the bent section against the ground member and to move the bight portion in a direction away from the bent portion, thereby causing the hook member to pull the wrap section in the same direction and to tighten same against the ground member.

By disposing the collar member on the bight portion of a performed U-shaped strap section directly overlying the inwardly bent strap section, such that the screw member frictionally engages the bent section substantially perpendicularly thereto, there is no longer any possibility of the screw member being mispositioned and thus proper grounding is ensured whenever the grounding strap of the invention is installed.

BRIEF DESCRIPTION OF THE DRAWINGS

The invention is illustrated by way of example in the accompanying drawings, in which.

DESCRIPTION OF PREFERRED EMBODIMENTS

Figures 1, 2, 3, 4, 5:
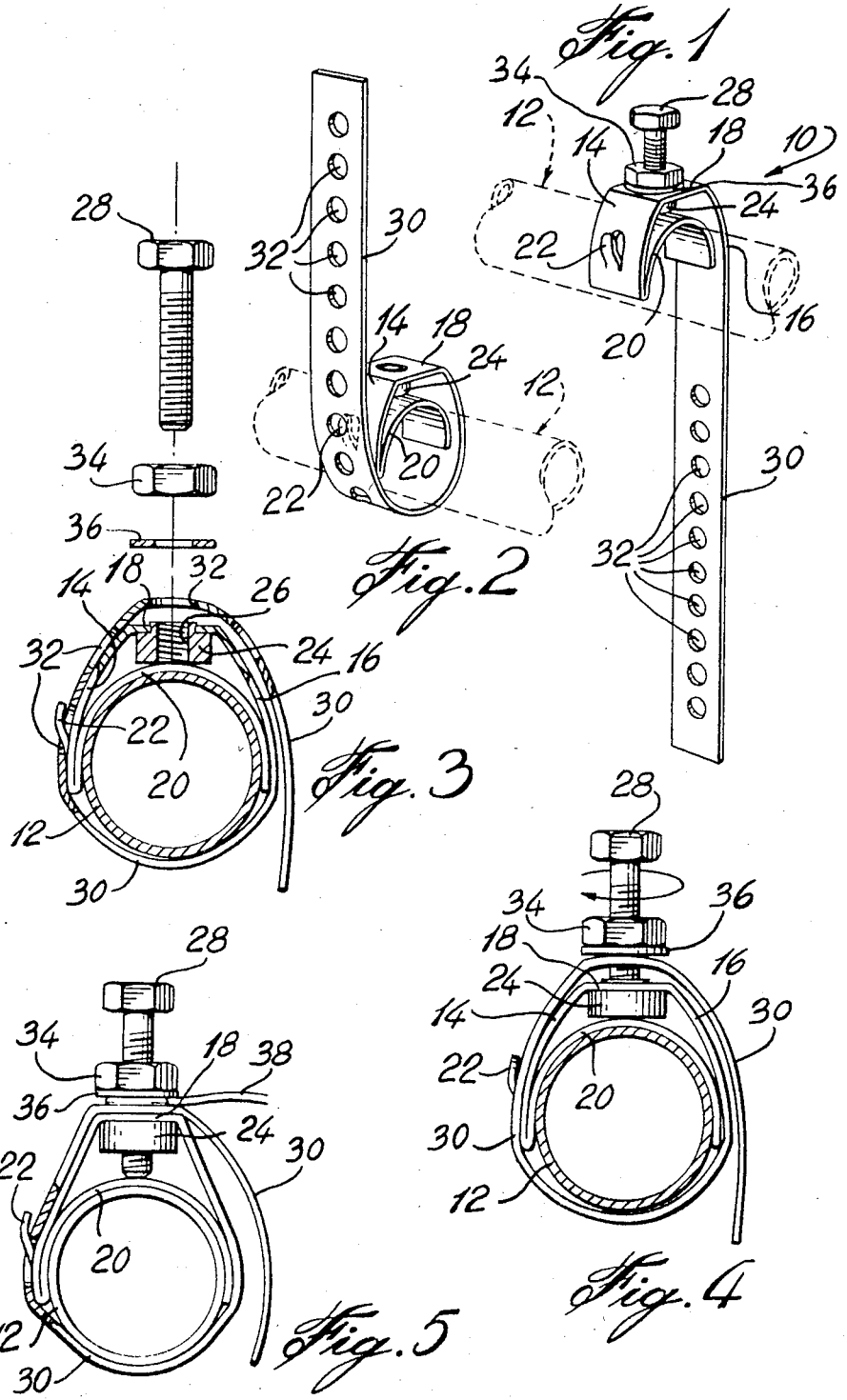
FIG. 1 is a perspective view of a grounding strap according to the invention as seen positioned on a ground member for installation thereon.
FIG. 2 is a view similar to that of FIG. 1, showing the grounding strap in a first stage of its installation.
FIG. 3 is a part sectional view showing the grouding strap in a second stage of its installation.
FIG. 4 is a part sectional side elevation view showing the grounding strap in a third stage of its installation.
FIG. 5 is another part sectional side elevation view showing the grounding strap as finally installed on the ground member.

Referring first to FIG. 1, the grounding strap illustrated and generally designated by reference numeral 10 is seen positioned for installation a ground member such as a grounded metal pipe 12 represented in broken lines. The grounding strap 10 is a one-piece copper preformed construction comprising a U-shaped section having a pair of curved leg portions 14 and 16 interconnected by a planar bight portion 18. The leg portion 14 is provided with an inwardly curved section 20 also of U-shape extending across the bight portion 18 and having one end integrally joined to leg portion 14 and the other end extending adjacent leg portion 16. As shown, the curved section is adapted to contact on its innerside the grounded pipe 12.

A hook 22 outwardly projects from leg portion 14. A collar 24 is riveted to the bight portion 18 on the side thereof facing the curved section 20. The collar 24 has threaded bore 26 adapted to threadably engage the threaded shank of screw member such as a bolt 28 and is disposed to permit the bolt 28 to frictionally engage the curved section 20 on its outerside perpendicularly thereto, as best shown in FIGS. 3 and 5.

The leg portion 16 is extended relative to leg portion 14 so as to define an elongated wrap section 30 adapted to bent about the ground member 12 and over the leg portion 14 and the bight portion 18 with the ground member 12 disposed between the curved section 20 and the wrap section 30. The wrap section 30 is provided with a plurality of longitudinally spaced apart holes 32 adapted to receive the hook 22 and also to register with the threaded bore 26 of collar 24 for receiving the bolt 28. A lock nut 34 and washer 36 complete the assembly.

In order to install the grounding strap 10 on the grounded pipe 12, the curved section 20 of the strap is first placed on the pipe 12, as shown in FIG. 1. Next, the wrap section 30 is bent around the pipe 12 and over the leg portion 14 while pressing it against the pipe in order to ensure a snug fit, as shown in FIG. 2; the strap hole 32 in closest alignment with the hook 22 is placed over the hook so as to connect the wrap section 30 to the leg portion 14. The bolt 28, lock nut 34 and washer 36 are removed and the wrap section 30 is further bent over the bight portion 18 so tht another strap hole 32 registers with the threaded bore 26 of collar 24, as best shown in FIG. 3. The bolt, nut and washer assembly is reinstalled and any extra length of the wrap section 30 is bent over the leg portion 16. Thereafter, as shown in FIG. 4, the bolt 28 is tightened so as to frictionally engage with the curved section 20 against the pipe 12; as a result, the bight portion 18 is moved in a direction away from the curved section 20, which causes the hook 22 carried by the leg portion 14 to pull the wrap section 30 in the same direction and to thereby snugly tighten same against the pipe 12. The final shape of the strap thus installed is represented in FIG. 5 and it is seen that the curved section 20 and wrap section 30 of the strap snugly conform to the pipe 12 and thus provide good grounding, the shank of the bolt 28 extending perpendicularly to the curved section 20. A ground wire 38 is placed between the lock nut 34 and washer 36 and the nut is finally tightly secured.

As an example of dimensions of a suitable grounding strap 10, the overall length may be about 5 inches and the width about ½ inch. Such a grounding strap accomodates pipe diameters of ½ through 1¼ inch. As it is apparent, it provides a versatile mechanical and electrical connection for grounding to metal pipes or posts, in addition to being fast and easy to install.

I claim:

1. A one-piece pliable metal grounding strap comprising:

an exterior U-shaped section having a pair of leg portions interconnected by a preformed bight portion;

one of said leg portions having a preformed inwardly bent interior U-shaped section having leg portions extending adjacent to respective leg portions of the exterior U-shaped section, said interior U-shaped section extending adjacent and across said preformed bight portion in opposed spaced apart relation thereto and being adapted to contact on one surface thereof opposite said exterior U-shaped section a ground member;

a hook member outwardly projecting from said one leg portion;

a collar member fixed to said bight portion, said collar member having a threaded bore defining a longitudinal axis and adapted to threadably engage a screw member, said bight portion having preformed bends on opposite sides of said collar member such that said longitudinal axis of said threaded bore of said collar member is oriented perpendicular to a part of said said interior U-shaped section directly opposite said collar member to permit said screw member to frictionally engage said interior U-shaped section on the other surface thereof substantially perpendicularly thereto;

the other leg portion of said exterior U-shaped section having a length extended relative to said one leg portion thereof to define an elongated wrap section adapted to be bent about said ground member and over said one leg portion and said bight portion with said ground member disposed between said interior U-shaped section and said wrap section, said wrap section being provided with a plurality of longitudinally spaced apart apertures adapted to receive said hook member and to register with said threaded bore for receiving said screw member, whereby tightening of said screw member causes said screw member to frictionally engage with the other surface of said interior U-shaped section facing said exterior U-shaped section and causes said one surface of said interior U-shaped section to frictionally engage with said ground member and to move said bight portion in a direction away from said interior U-shaped section, thereby causing said hook member to pull said wrap section in the same direction and to tighten same against said ground member;

whereby said preformed bight portion and said interior U-shaped section with the leg portions thereof extending adjacent respective leg portions of the exterior U-shaped section maintain said screw member perpendicular to said interior U-shaped section during tightening of said screw member.

2. A grounding strap as claimed in claim 1, wherein said collar member is fixed to said bight portion on the side thereof facing said interior U-shaped section.

3. A grounding strap as claimed in claim 2, wherein said collar member is riveted to said bight portion.

* * * * *